US005758783A

United States Patent [19]

Maglione

[11] Patent Number: 5,758,783

[45] Date of Patent: Jun. 2, 1998

[54] STACKABLE TRAY AND DISPLAY STAND

[76] Inventor: Stephen Thomas Maglione, 71 Baltusrol Way, Far Hills, N.J. 07931

[21] Appl. No.: 745,907

[22] Filed: Nov. 7, 1996

[51] Int. Cl.[6] ..... A47F 3/14

[52] U.S. Cl. ..... 211/126.2; 211/126.16

[58] Field of Search ..... 211/73, 126.6, 211/126.1, 126.16, 130.1, 132.1, 133.1, 195, 128.1, 194; 248/174; 206/730, 740, 741, 745

[56] References Cited

U.S. PATENT DOCUMENTS

| | | | |
|---|---|---|---|
| 2,320,388 | 6/1943 | Shaw . | |
| 2,490,269 | 12/1949 | Johnson | 211/126.16 X |
| 3,269,556 | 8/1966 | Streater | 211/132.1 |
| 3,339,752 | 9/1967 | Trogan . | |
| 3,524,553 | 8/1970 | Zitmore . | |
| 3,592,344 | 7/1971 | Schade | 211/132.1 X |
| 3,862,689 | 1/1975 | Taub | 211/126.16 X |
| 4,708,240 | 11/1987 | McMahon et al. . | |
| 5,042,651 | 8/1991 | Davis et al. . | |
| 5,161,699 | 11/1992 | Hanna et al. . | |
| 5,230,423 | 7/1993 | Gellatly | 211/132.1 X |
| 5,322,172 | 6/1994 | Maglione . | |
| 5,513,745 | 5/1996 | Zoltan et al. | 206/741 |
| 5,630,518 | 5/1997 | Collins | 211/132.1 |

*Primary Examiner*—Blair Johnson

[57] ABSTRACT

A tray is formed of a single corrugated sheet of paperboard and has two opposite side walls formed by overlapping panels creating a slot between the panels in each side wall. A pair of tabs depends from each side wall for engaging the slots of a next lower tray. A support box has crossed upright support members therein to support the trays. The box has two upstanding tabs on opposite sides to engage the side wall slots at the bottom wall of the lowermost trays. A triangular cap has two depending tabs on each side for engaging the slots of the trays in an uppermost tier. Straps on each tray secure that tray to slots in the next upper tray. The tray bottom wall is formed into two sections with a forward section inclined and formed of multiple layers of sheets to enhance the strength of the forward section. The trays are stacked in back-to-back relation in any number of levels and have a tree-like appearance from the side and are accessible from opposite fronts of the display stand.

33 Claims, 9 Drawing Sheets

STACKABLE TRAY AND DISPLAY STAND

The present invention relates to stackable trays for forming a display stand, and more particularly, to corrugated paperboard trays and display stands.

Of interest is commonly owned U.S. Pat. No. 5,322,172.

Generally, stackable trays including molded thermoplastic trays and corrugated paperboard trays are known. For example, U.S. Pat. No. 4,708,240 discloses stacked trays on a support. The trays comprise open top four sided rectangular containers. A connector connects an upper tray to a lower tray. A support has notches for supporting the lowermost tray tilted with its open top inclined in a forward direction. The connector has an upwardly extending front wall, a bottom wall and depending forward tabs on its sides which are adapted to interlock with the side wall edges of a lower tray. The connector also has depending rear panels which straddle the sides of a lower tray. The connector is placed on each lower tray for receiving an upper tray. All trays are thus tilted and face in a forward direction. The disadvantage of this arrangement is that it requires a separate connector to stack the trays which adds cost and is limited to accessing the trays from only a forward direction.

U.S. Pat. No. 2,230,388 to Shaw discloses metal stacked bins which are formed of elements attached with weld joints. Flanges at the rear of a bin form legs which support the bin and its bottom wall tilted forwardly and downwardly to cause items stored in the bin to move forward by gravity. The bottom wall has an upwardly tilted forward section to hold the items in the bin. Downwardly depending lugs are secured to the sides of each bin for straddling the sides of a lower bin to prevent relative lateral displacement of the upper bin. The rear depending legs of an upper bin straddle the legs of a lower bin. This is a relatively costly arrangement requiring numerous welds and elements.

U.S. Pat. No. 3,524,53 discloses a stackable desk tray molded of plastic material for receiving letter and legal size papers. Each tray includes a pair of spaced side walls each having an upper edge. Depending from each side wall is an outer skirt and an inner foot which form a channel for receiving the upper edge of a stacked lower tray. The side walls are flexed somewhat to protect against accidental disengagement of the edges and channels. The skirts are externally visible and detract from the tray appearance. The trays also need to be manually aligned in the forward-rearward direction to effect different stack alignment configurations.

U.S. Pat. No. 5,042,651 is somewhat similar to U.S. Pat. No. 5,322,172 noted above in that both employ a vertical support for receiving and securing a plurality of vertically aligned identical but spaced trays. Further, each patent discloses a cap secured at the top of the vertical support. The vertical support has a fixed height and receives a fixed number of trays secured thereto.

U.S. Pat. No. 5,161,699 discloses a stacked stair structure comprising tilted trays oriented and shaped similar to the containers disclosed in U.S. Pat. No. 4,708,240 discussed above. No connector is employed however in the '699 patent. Each container has a central divider with depending tabs that engage and protrude through slots in the bottom wall thereof. The depending tabs engage a rear edge of a lower container upper wall to maintain the position of the upper container to the lower container. The stair structure is supported on a lower support which supports the containers tilted.

The present inventor recognizes a need for an aesthetically pleasing display stand comprising stackable trays arranged to avoid additional attaching elements. Preferably, the trays can form opposing oppositely facing stacks on a support for supporting the stacks. Further, it is preferable that a cap be provided for completing and enclosing the top of the stack upper tray bins. Further, it is recognized that a need is seen for providing interchangeability of the trays with each other, with the support and with the cap to maximize flexibility in arranging the stacks.

A display stand according to the present invention comprises a tray support and first and second identical trays each having opposing side walls and a rear wall extending upwardly from a bottom wall forming an open front of the tray, each tray being supported by the support in back-to-back mirror relation with the rear walls next adjacent and a cap overlying the first and second trays.

In one aspect, the side walls each have an inclined forward edge, the cap having inclined forward and rear surfaces terminating at an apex, the cap surfaces being substantially parallel to and coextensive with the side wall forward edges.

In a further aspect, the trays include identical stacking means for stacking the trays one over the other and include a plurality of the trays identical to and stacked on the first and second trays forming two back-to-back tray stacks facing in opposing directions.

In a further aspect, the first and second tray side walls have bottom and upper edges and comprises a pair of juxtaposed walls forming a vertical slot in communication with the side wall bottom and upper edges, the first and second trays each further including a tab extending from one of the tray bottom and upper edges at each the side wall for engaging a side wall slot of a pair of further trays respectively stacked with the first and second trays.

In a still further aspect, in a display stand comprising at least one stackable first tray, the first tray comprises a bottom wall having opposing side edges and a rear edge. A pair of spaced side walls extend upwardly from the bottom wall at the opposing side edges, the side walls each comprising a pair of juxtaposed walls forming a slot therebetween, the side walls having an upper edge and a bottom edge, the slot being in communication with at least one of the upper and bottom edges. A rear wall extends upwardly from the bottom wall rear edge and is joined to the side walls to form a U-shaped wall therewith. A pair of tabs extend from and substantially coextensive with each side wall at one of the side wall upper and bottom edges for corresponding to and engaging one of the slots of a second of the plurality of trays stacked therewith.

In a further aspect, the pair of tabs comprise a tab downwardly depending from each the side wall bottom edge and the slot is upwardly facing in communication with each the side wall upper edge.

In a still further aspect, the rear wall has an upper edge, the first tray further including a strap member extending upwardly from the rear wall upper edge, and a second tab extending from the strap member distal the rear wall upper edge, the rear wall having a first slot therein for receiving the strap member of the second tray, the bottom wall having a second slot for receiving and interlocking the second tab thereto for securing the second tray to the first tray in stacked relation.

IN THE DRAWING

Figure 1:
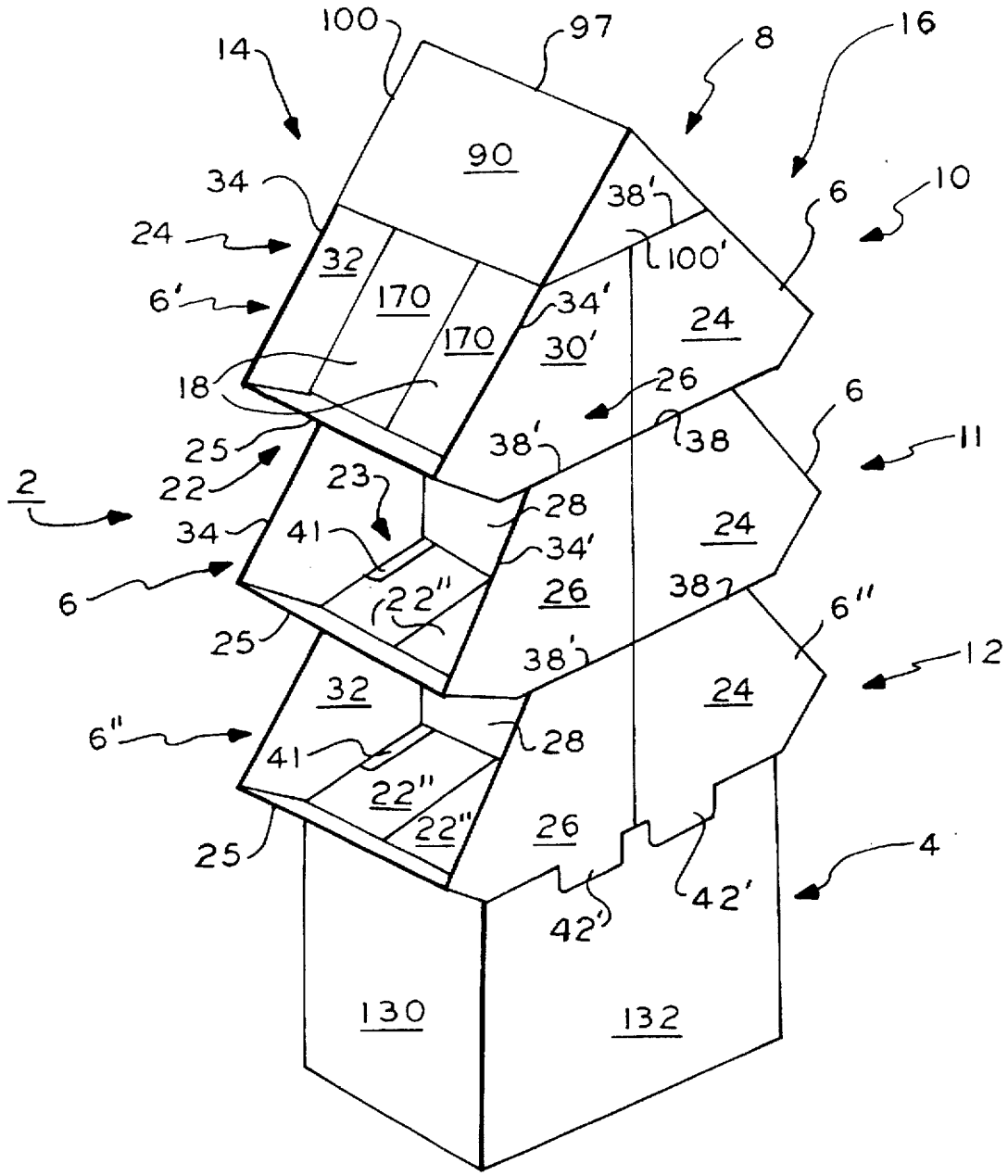
FIG. 1 is an isometric view of a display stand according to one embodiment of the present invention.
Figure 4:
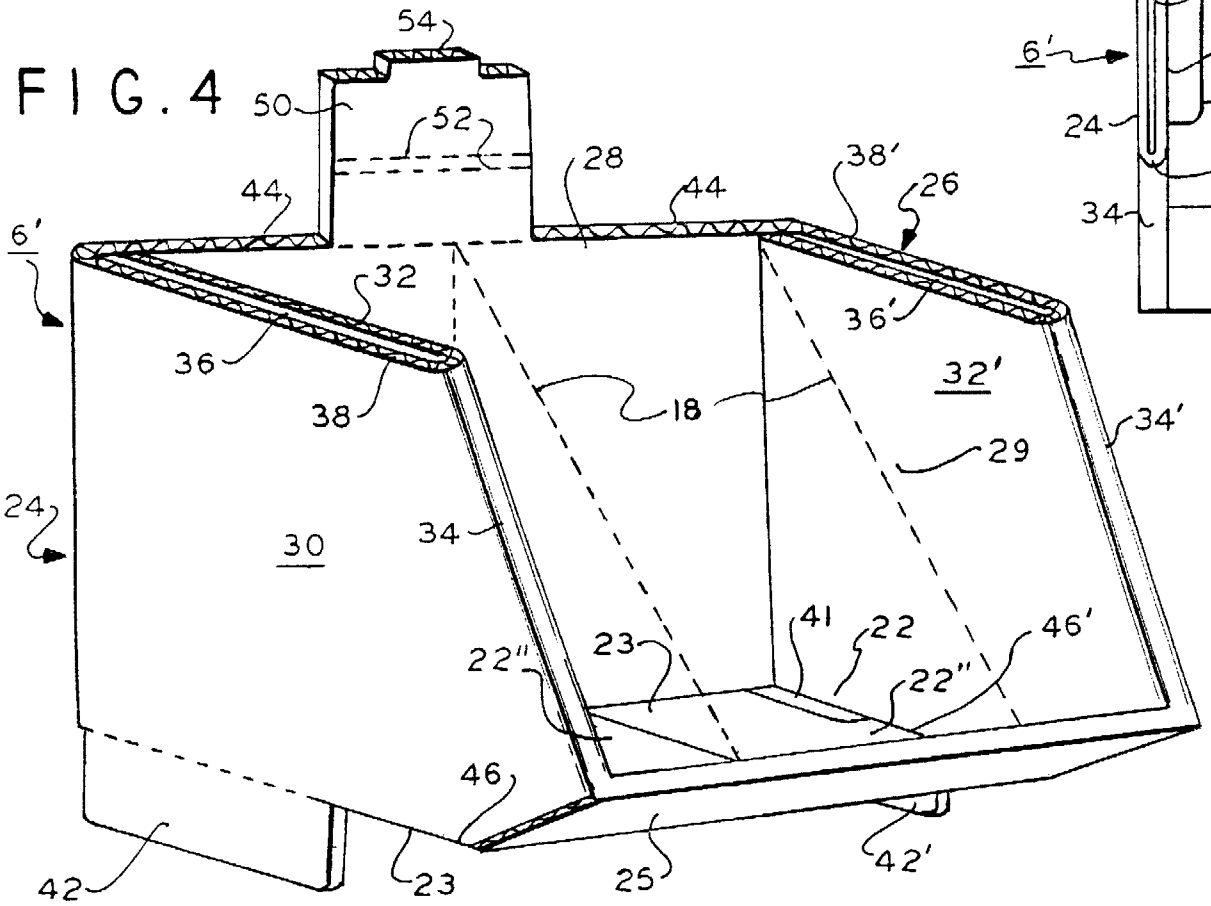
FIG. 4 is an isometric view of a representative tray used in the display of FIG. 1 prior to stacking in the display.
Figure 7:
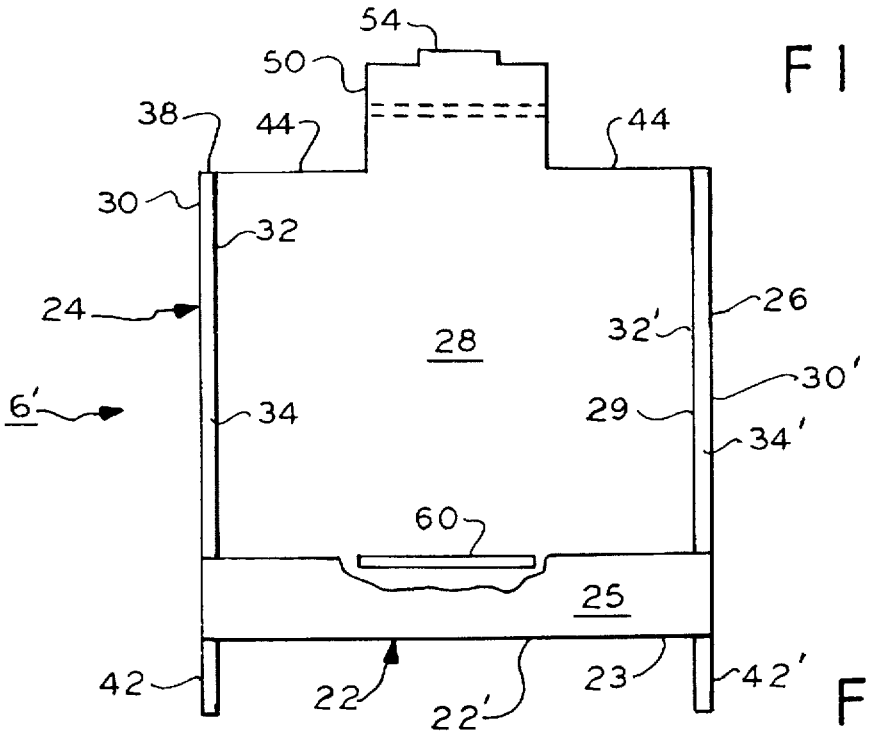
FIG. 7 is a front elevation view of the tray of FIG. 4.
Figure 8A:
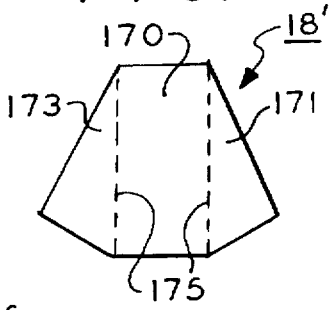
Figure 8:
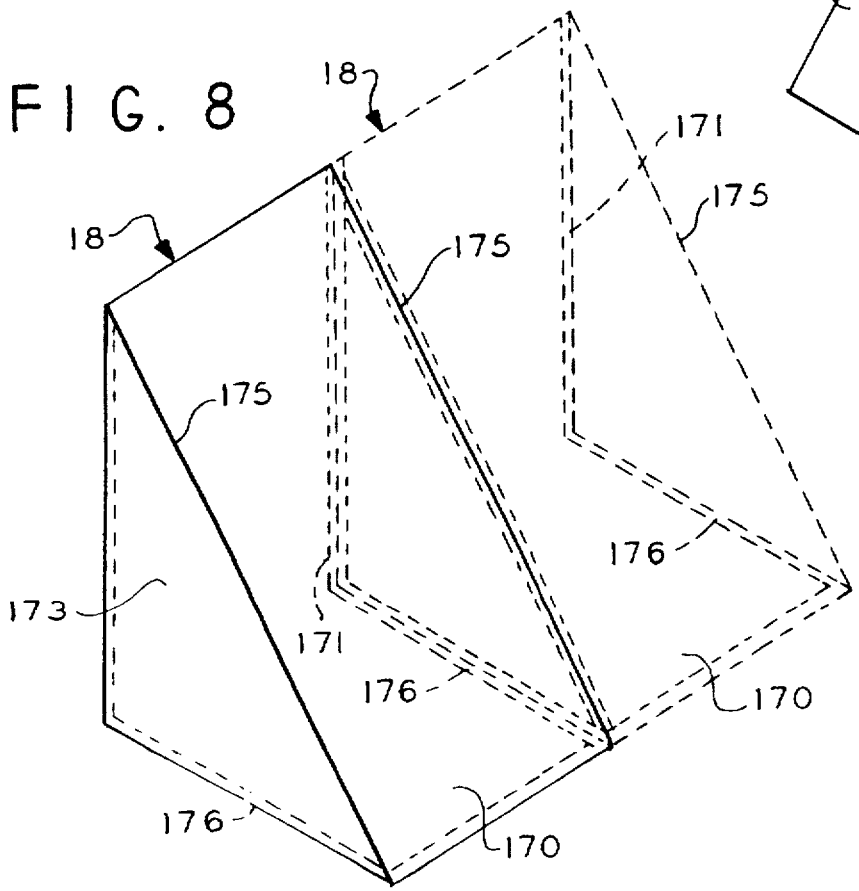
Figure 9:
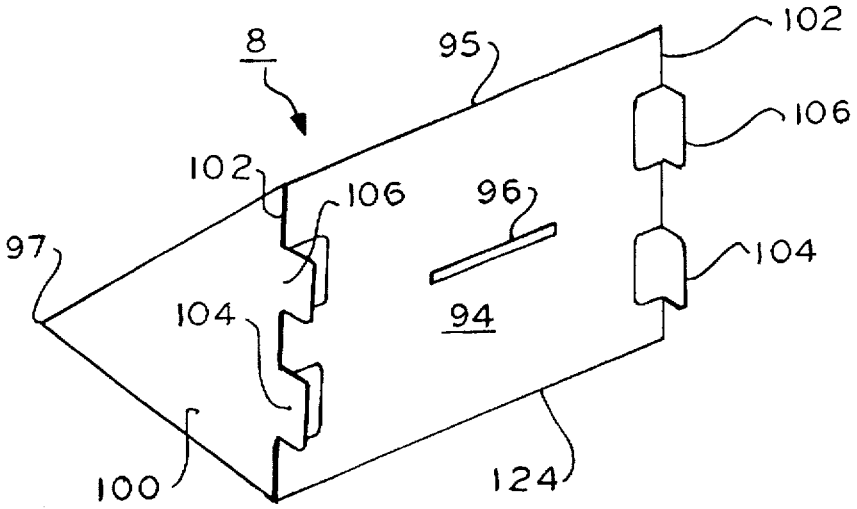
Figure 10:
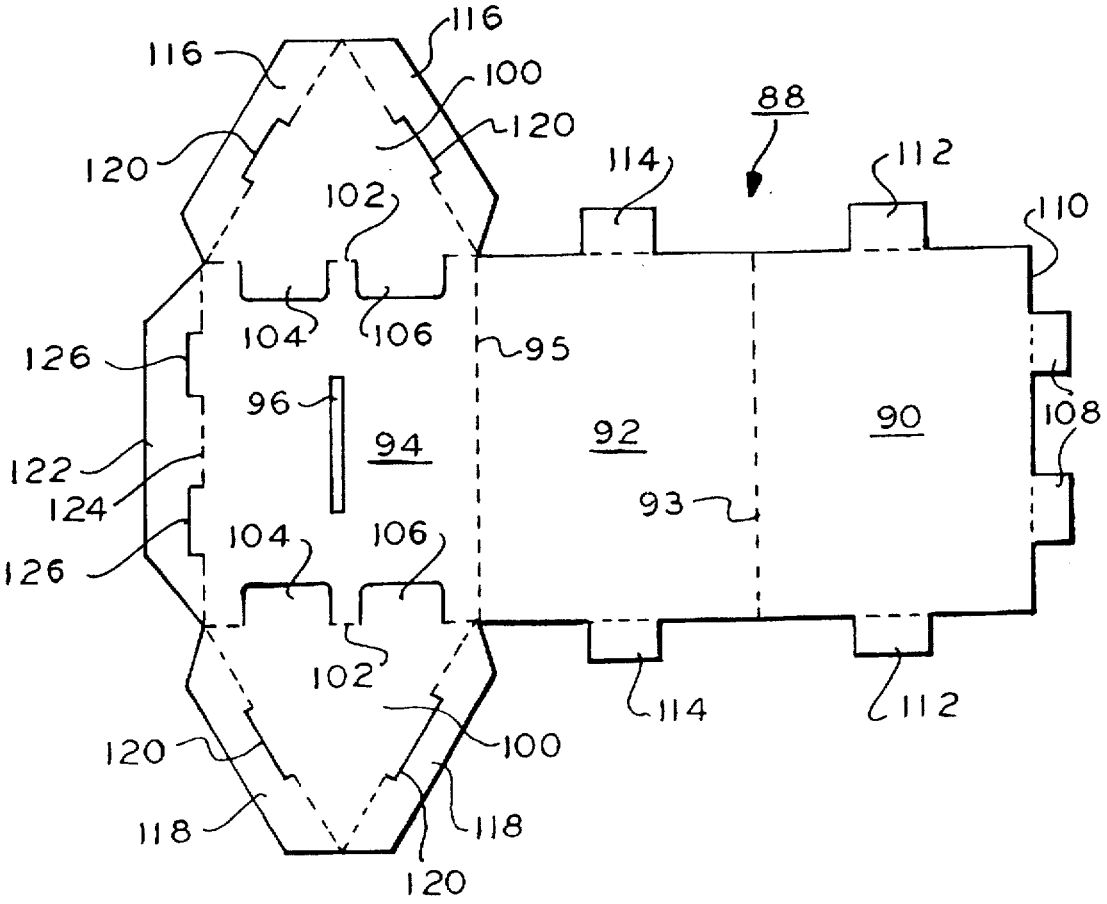
Figure 11:
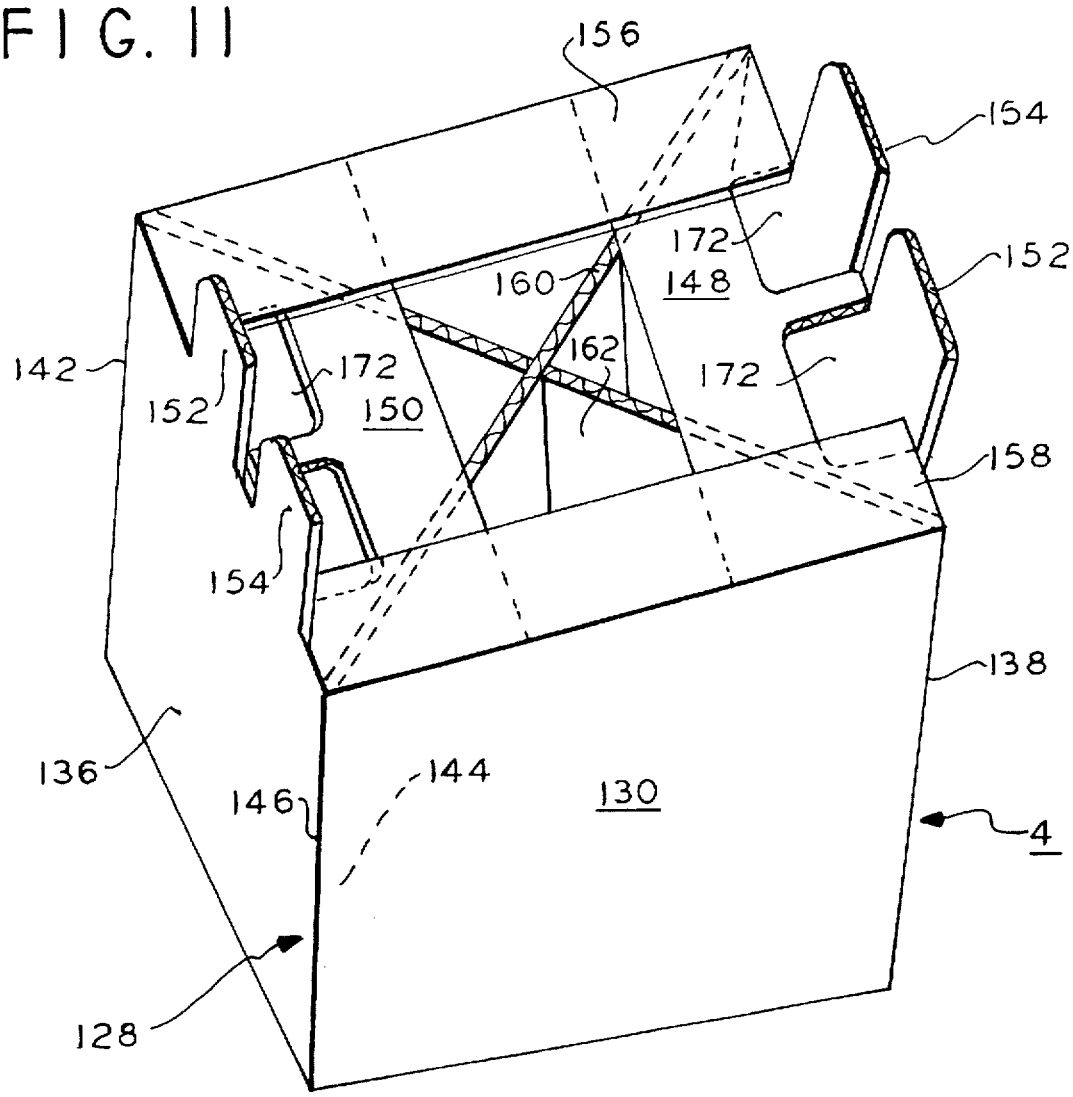
Figure 12:
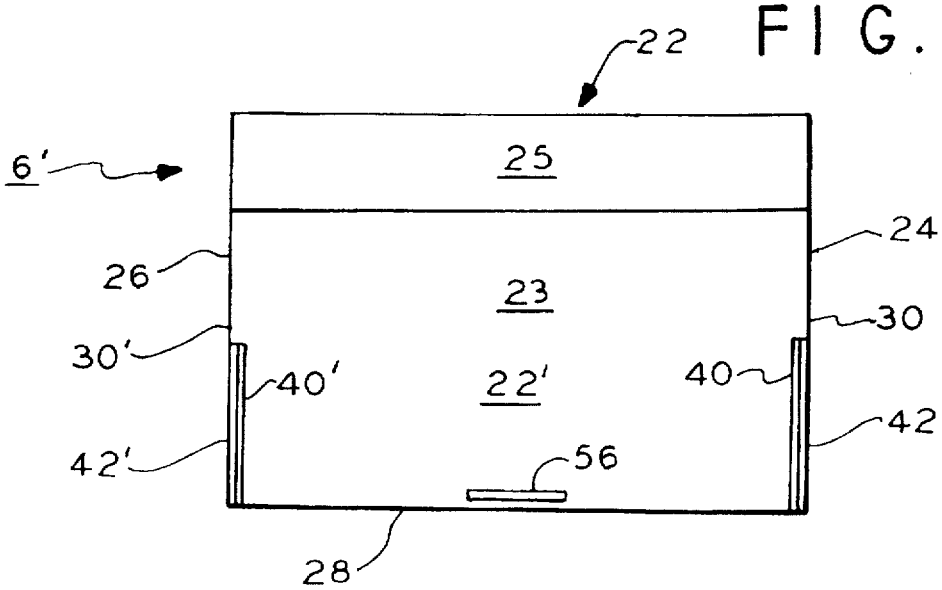
Figure 13:
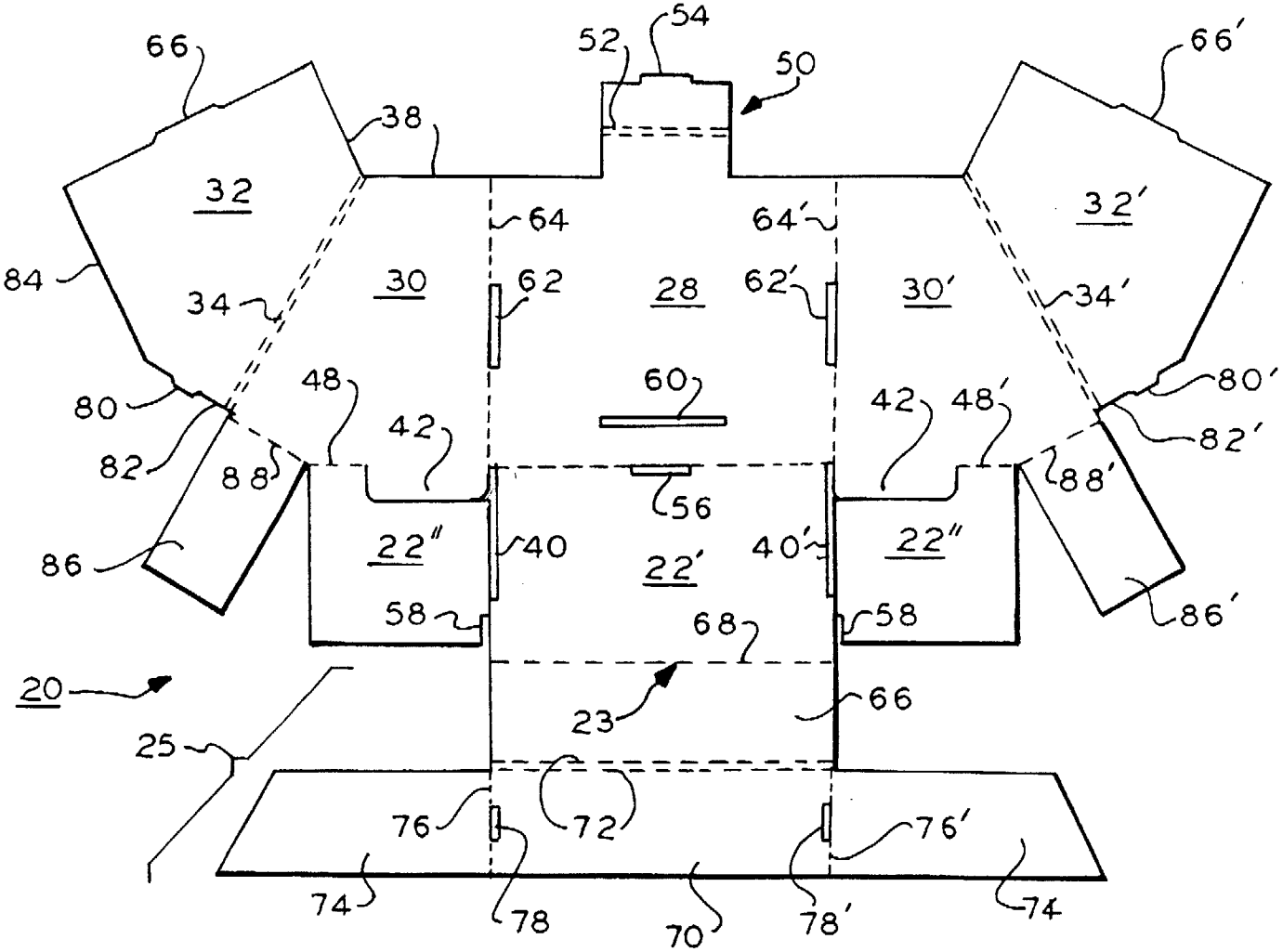
Figure 14:
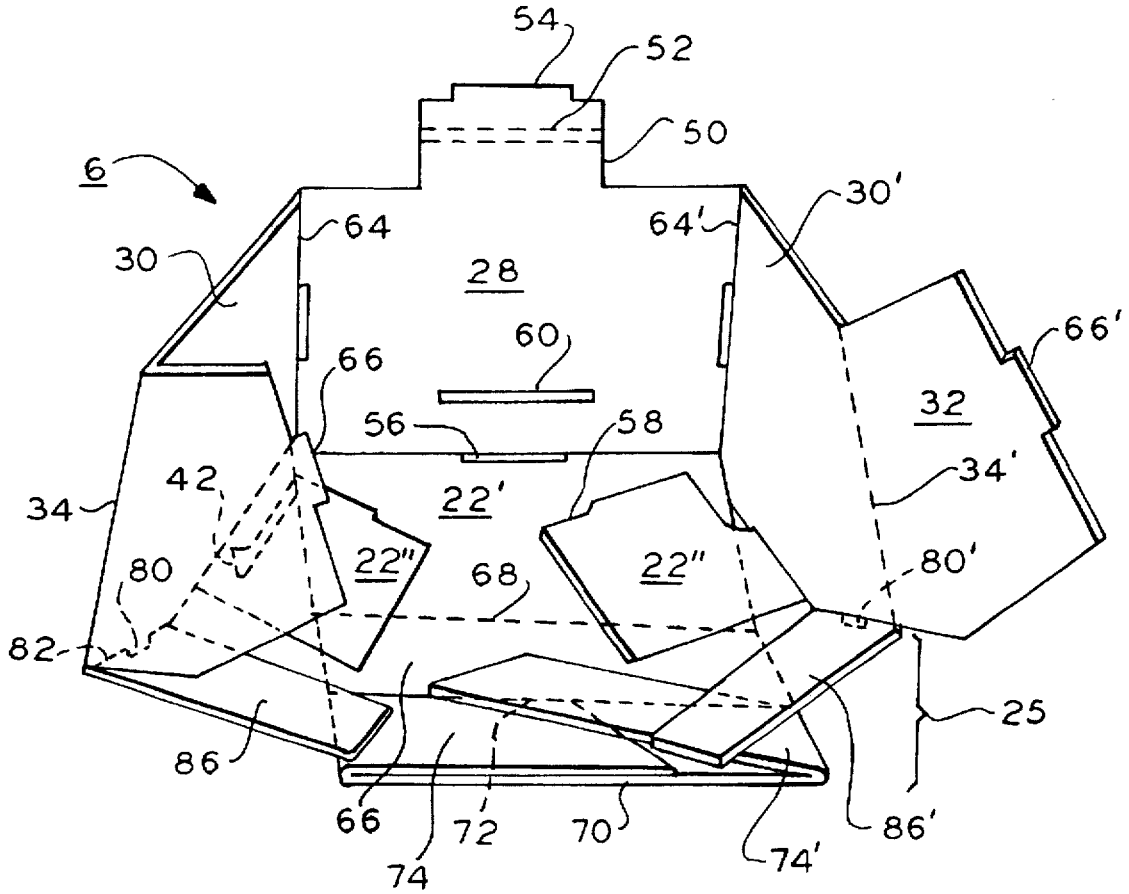
Figure 16:
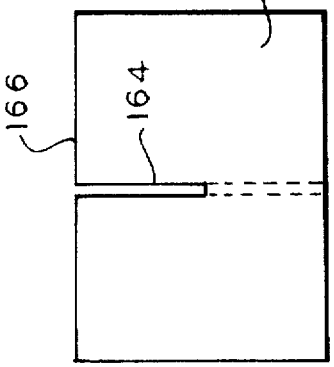
Figure 15:
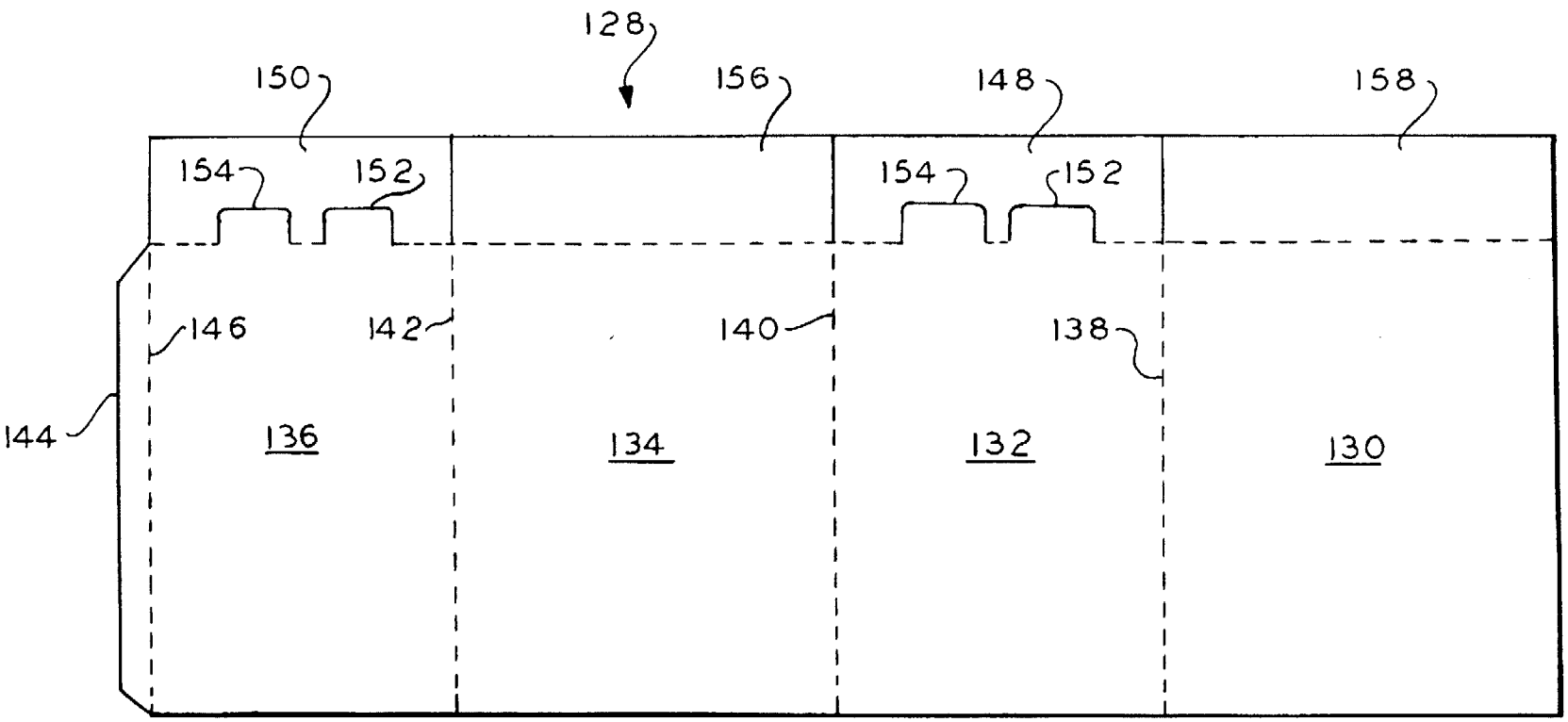

FIGS. 8 and 8*a* are respective isometric and blank plan views of an insert used in the stand of FIG. 1;

FIG. 9 is an isometric bottom view of the cap used in the embodiment of FIG. 1;

FIG. 10 is a plan view of a blank used to form the cap of FIGS. 1 and 9;

FIG. 11 is an isometric view of a support used in the display of FIG. 1;

FIG. 12 is a bottom plan view of the tray of FIG. 4;

FIG. 13 is a plan view of a blank used to form the tray of FIG. 4;

FIG. 14 is an isometric view of the tray of FIG. 4 partially assembled from the blank of FIG. 13;

FIG. 15 is a plan view of the blank used to form the main box of the support of FIGS. 1 and 11; and FIG. 16 is a plan view of a representative blank used to form a tray support in the support of FIGS. 1 and 11.

In FIG. 1, display 2 comprises a support 4 on which are stacked a plurality of identical trays 6, 6' in back-to-back relation. A cap 8 is on the uppermost level 10 of trays 6. The trays 6 are stacked in three levels 10, 11 and 12 by way of example. In the alternative, there may be more or fewer than three levels of trays 6 as desired. In a further alternative, the stack of trays may be formed as a single stack and the support reduced in transverse tray support area accordingly (not shown) to support such a single stack (not shown). In the single stack, there also may be more or fewer than three trays on the support. A first stack 14 of three trays 6 is back-to-back with a second stack 16, with at least the trays 6 of the upper level 10 preferably attached at their back walls by bonding or other securing means.

A pair of inserts 18 are assembled to one of the trays 6'.

Each of the support 4, trays 6 and cap 8 is preferably formed of relatively stiff paperboard, single or multiple plies, such as cardboard, fiberboard, corrugated paperboard and corrugated fiberboard. However they may be formed of other materials such as a sheet of thermoplastic having the desired stiffness and strength for repeated folding stress at foldlines. Such other materials may also include paper-plastic laminated and plastic composite sheet material, for example.

In FIGS. 2–7,12 and 13, representative tray 6' comprises a single sheet of single ply corrugated paperboard formed from a blank 20, FIG. 13. The tray 6' has a bottom wall 22, a pair of side walls 24 and 26 extending normal to and upwardly from the bottom wall 22 at opposite side edges thereof and a rear wall 28 extending upwardly from and normal to the bottom wall 22 at a rear edge thereof. The walls form a bin 29 in the tray 6'. The bottom wall 22 has a rear section 23 and a forward tilted section 25.

The side walls 24 and 26 are identical mirror images of each other. Representative side wall 24 comprises two panels, outer panel 30 and inner panel 32 of paperboard folded over in juxtaposition with each other at fold 34. The panels 30 and 32 form a vertical slot 36 therebetween for the full height of the panels. Slot 36 is in communication with the upper edge 38 of the side wall 24. The slot 36 is in communication with the lower edge of side wall 24 inner panel 32 and with the outer panel 30 through a slot 40 (FIG. 12) in the bottom wall 22 rear section 23. Thus the slot 36 is in communication with the upper and lower edges of the side panel 24.

A tab 42 extends downwardly from and is coextensive with the outer panel 30 and passes through the slot 40. The outer panel 30 is substantially coplanar with the side edge of the bottom wall section 23. The other side wall 26 has identical components as sidewall 24 with the same reference numerals but primed. The tab is dimensioned to engage the slot 36 of the next lower tray 6 in the stack. The tab 42 and the slot 36 have a length in the rear to front direction sufficient to hold the upper tray 6' in alignment with the lower tray 6. Further, because the tab 42 is inside the slot 36 covered by the external panel 30 and internal panel 32, the tab 42 is not visible externally the trays 6 and 6' or in the bin 29 at their interface. The upper edges 44 of the rear wall 28 and the sidewall edges 38, 38' of tray 6 supports the upper tray 6' at the tray 6' bottom wall 22 section 23.

The bottom wall 22 section 23 comprises a lower bottom panel 22' and two mirror image upper flap panels 22" juxtaposed on the lower panel 22'. The panels 22" have a respective slot 41, 41' accommodating the tabs 42 and 42' and aligned with the slots 40, 40' in the bottom panel 22'. The panel 22", FIG. 4, is hinged to the lower edge 46 of outer panel 30 at a fold line 48 (FIG. 13) thereat.

In FIG. 4, a rectangular strap member 50 extends upwardly from and coextensive with rear wall 28 centrally thereof. A pair of fold lines 52 extend transversely across the member 50. It should be understood that a fold line herein is a crease in the material to assist folding the material at the crease forming a hinge thereat. In thermoplastic material this is referred to as a living hinge. A tab 54 extends upwardly and coplanar with the member 50.

Figure 6:
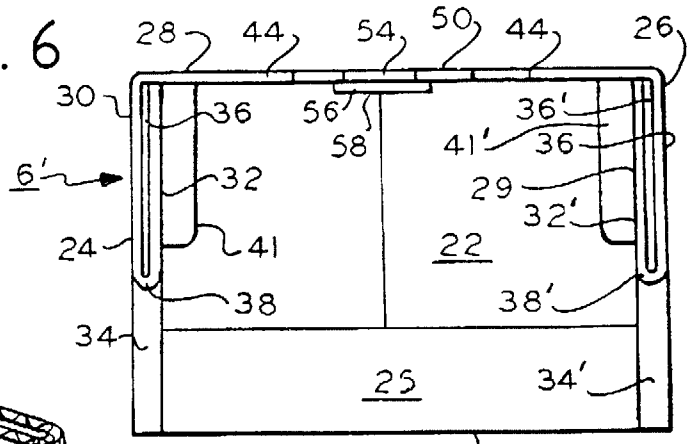
FIG. 6 is a top plan view of the tray of FIG. 4.
Figure 5:
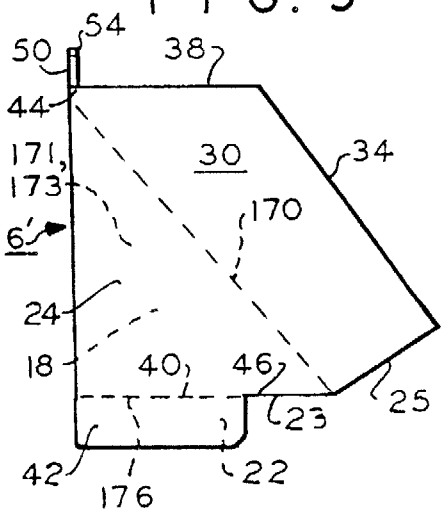
FIG. 5 is a side elevation view of the tray of FIG. 4.

The bottom wall 22 panel 22', FIGS. 6, 12 and 13, has a slot 56 adjacent to the rear wall 28. The panels 22" have a recess 58 aligned with and which accommodate the slot 56 to form a continuous slot through wall 22. the slot 56 receives the tab 54 of strap member 50, FIG. 3. The rear wall 28 has a slot 60, FIGS. 3, 7, 13 and 14. Slot 60 receives the strap member 50 therethrough, FIG. 3, for securing a lower tray 6 to an upper tray 6'. The slot 56 serves to interlock the complementary tab 54 thereto to serve as a "Walker Lock" type arrangement.

As best seen in FIG. 13, the rear wall 28 has two slots 62, 62' at the fold lines 64, 64' between the rear wall 28 and side panels 30, 30' respectively. The slots 62 receive complementary tabs 66, 66' extending from an edge of respective panels 32, 32', securing the panels 32, 32' in juxtaposed relation over the exterior panels 30, 30' in "Walker Lock" type arrangement.

The inclined forward section 25 of bottom wall 22 comprises multiple layers of sheet material. As best seen in FIGS. 13 and 14 the front inclined section 25 of a typical tray 6 comprises a panel 66 hinged to panel 22' at fold line 68. A further panel 70 is hinged to panel 6 at two fold lines 72. Two side flaps 74 are hinged to panel 70 at opposite edges thereof at respective fold lines 76, 76'. Two "Walker Lock" type slots 78, 78' are in panel 70 at fold lines 76, 76'. The slots 78, 78' respectively receive tabs 80, 80' extending from edges 82, 82' of panels 32, 32', respectively. Edges 82, 82' abut panel 70 in the folded assembled state of a tray 6. The tabs 80, 80' lock the panels 70, 74 and 66 in the folded state. Edge 84, panel 32, abuts rear wall 28 at fold line 64 with tab 66 engaged with rear wall 28 slot 62. The flaps 74 overlap each other and panel 70 in the folded state.

A further flap 86 extends from fold line 88 of panel 30. Flap 86 overlies one half of the folded flaps 74, 74' and panel 70. Corresponding flap 86' extends from panel 30' and overlaps the other half of the flaps 74, 74' and panel 70.

To assemble a tray 6, FIG. 14, the flaps 74 are first folded over the panel 70. The panels 30 and 30' are then folded at fold lines 64, 64' respectively, until they overlap the bottom wall panel 22' at the wall side edges in section 23. This action places the flap 86 over the flaps 74 and 70 on one half thereof and the flap 86' over the other half thereof. Simultaneously, the bottom wall 22 upper panels 22" are placed over the bottom panel 22' as seen in FIG. 6. At this time the tabs 66, 66' are engaged with the mating slots 62, 62' respectively, and the tabs 80, 80' are engaged with their mating slots 78, 78' respectively. This action secures the forward section 25 in place as shown in FIG. 4. The section 25 thus comprises four thickness of corrugated sheet material. This provides a relatively strong, stiff forward lip to the tray so that it can withstand abuse when in use.

In FIGS. 9 and 10, the cap 8 comprises a single sheet 88 of single ply corrugated paperboard. The cap comprises panels 90, 92 and 94 of preferably like rectangular peripheral dimensions. The panel 94, however, may have different peripheral dimensions according to a given implementation. Panels 90 and 92 are joined by fold line 93. Panels 92 and 94 are joined by fold line 95. Fold line 93 forms apex 97 of the cap 8, FIG. 9. Panel 94 has a central slot 96. Triangular, preferably equilateral, shaped identical panels 100, 100' extends from panel 94 at opposite edges thereof at fold lines 102. A pair of tabs 104, 106 extend from each of the panels 100, 100' adjacent to corresponding fold lines 102. The tabs 104, 106 are preferably identical to tabs 42, 42' depending from the side walls 24 and 26, FIG. 4. They only need be dimensioned to engage the slots 36 of the trays 6, 6'.

A pair of like tabs 108 extend from an edge 110 of panel 90, FIG. 10. A pair of like tabs 112 extend from opposite edges of panel 90 normal to edge 110. A pair of like tabs 114 extend from opposite edges of panel 92. The tabs 108, 112 and 114 may be identical and extend from respective fold lines at the corresponding panels.

A pair of like flaps 116 extend from fold lines at adjacent edges of panel 100 and a like pair of flaps 118 extend from fold lines at adjacent edges of panel 100'. A slot 120 is formed in each of the flaps 116 and 118 at their respective fold lines at panels 100 and 100'. A flap 122 extends from fold line 124 of panel 94 normal to fold lines 102.

Figure 2:
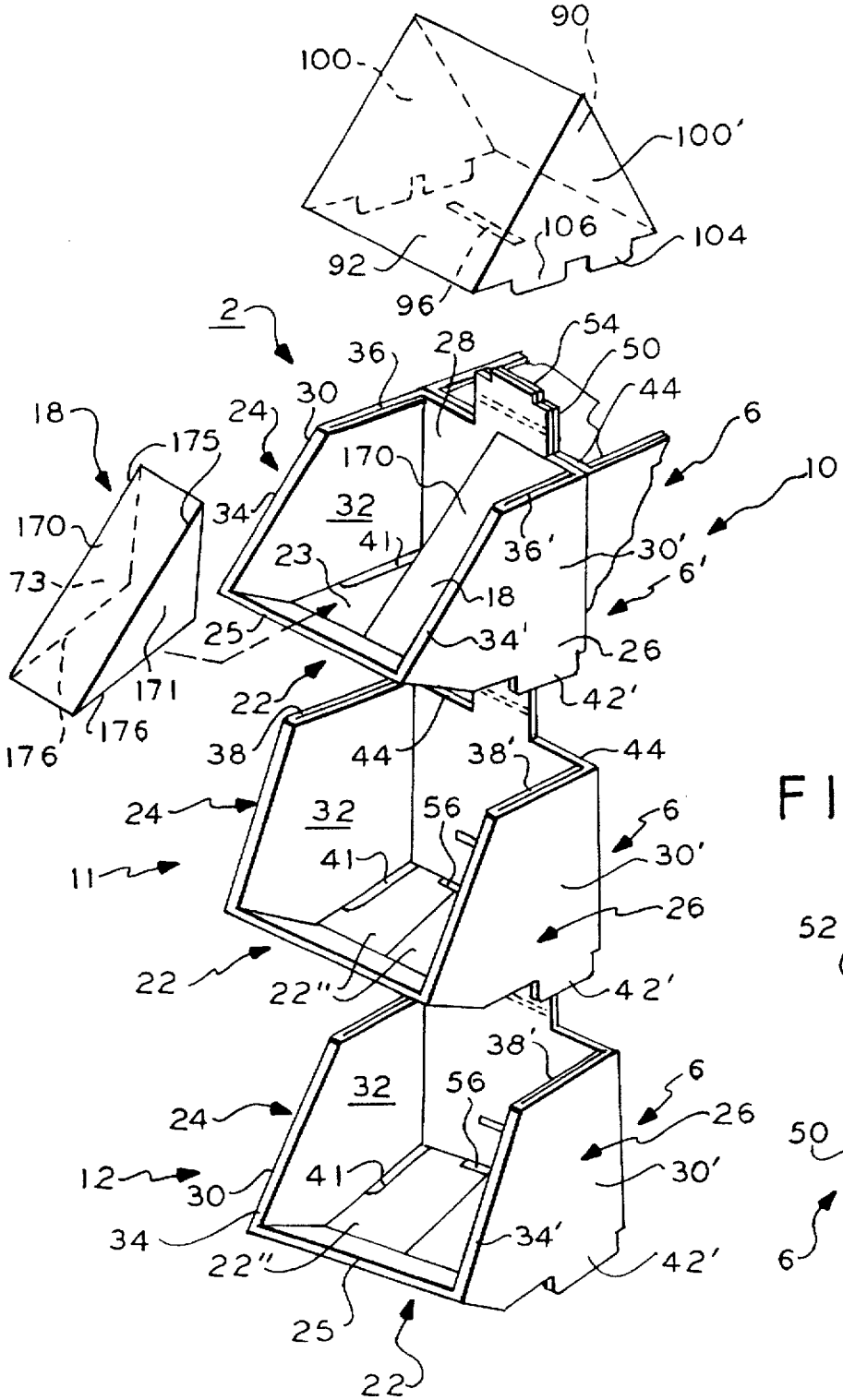
FIG. 2 is an exploded view of a portion of the stand of FIG. 1.
Figure 3:
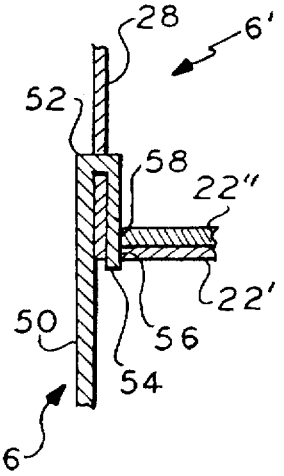
FIG. 3 is a fragmented sectional elevation view through a rear wall of one of the trays of FIG. 1.

The slots 120 of panel 100 receive the tabs 112 and 114 on one side of the panels 90 and 92. The slots 120 of panel 100' receive the other tabs 112 and 116 of panels 90 and 92. Slots 126 in flap 122 receive tabs 108. The assembled cap appears as shown in FIGS. 1, 2 and 9. The slot 96 in the bottom wall formed by panel 94 receives the upstanding strap member 50 of the next adjacent trays 6 and 6', FIG. 2.

As shown in FIG. 1, the panels 90 (and 92 not shown in this Fig.) form a continuous coplanar surface with the inclined forward edges 34 and 34' of the uppermost trays 6, 6'. In side elevation view (not shown), the cap 8 and uppermost trays 6, 6' appear as a continuous structure with only the interface between upper tray edge and the cap 8 lower edges visible. The tabs 104 and 106 of the cap and the tabs 42, 42'of the trays are not visible at the interface with a lower tray 6. The entire structure from the side forms two stacks in back-to-back relation which appear tree-like in configuration with each tray resembling a tree branch somewhat similar to an idealized Christmas tree.

The lowermost trays 6", identical to trays 6' and 6, are supported on a base support 4, FIG. 1. In FIGS. 11 and 15, the base support 4 comprises a box-like structure 128. In FIG. 15, the structure 128 comprises four panels 130, 132, 134 and 136 interconnected by respective fold lines 138, 140 and 142. The panels 130 and 134 are identical and the panels 132 and 136 are identical in peripheral dimensions. The blank forming the structure 128 is a single ply of corrugated paperboard. A flap 144 is attached to panel 136 by fold line 146 and bonded to panel 130 to form a conventional box-like arrangement.

Flaps 148 and 150 are identical and extend from corresponding fold lines at respective panels 132 and 136. Tabs 152 and 154 extend from the panels 132 and 136 adjacent to the respective fold lines thereof. Tabs 152 and 154 are dimensioned to engage the lower portions of slots 36 at the bottom wall of the trays 6", FIG. 1. The tray 6" tabs 42', FIG. 1, straddle the exterior panel 132 (and depending tray 6" tabs 42 with panel 136) of the support 4.

In FIG. 15, a flap 156 extends from a fold line of panel 134 and a flap 158 extends from a fold line of panel 130, all of the flaps 148, 150, 156 and 158 extending from coextensive fold lines in the blank form of FIG. 15.

To provide vertical load support for the stacked trays a pair of upright cross divider support members 160 and 162 are in the cavity of the structure 128. The members 160 and 162 extend diagonally across the interior volume of the structure 128 in crossed relation. In FIG. 16, representative divider support member 160 is a rectangular sheet corrugated material having a central slot 164 at one edge 166 thereof. The other member 162 is identical to member 160, but is assembled in reverse orientation to member 160 with the central slots thereof interlocked and aligned with each other and engaged with the other member shown in phantom in FIG. 16

The inserts 18, FIG. 8, are each formed of a single sheet of corrugated paperboard having the shape of the blank 18', FIG. 8*a*. Fold lines 175 are shown by the dashed lines similar to all fold lines for the various blanks described herein. The blank 18' is formed into an insert 18 by folding triangular legs 171 and 173 at respective folds lines 175. The leg 175 are folded at right angles to the surface 170 as shown in FIGS. 2 and 8. When folded, the legs are parellel to each other. The legs 171 and 173 have bottom edges 176. In FIG. 2, the insert 18 has two side flaps formed by legs 171 and 173 and a rectangular surface 170 hinged to legs 171 and 173 at fold lines 175.

The edges 176 of two adjacent inserts 18, for example, FIG. 8, wherein one insert is shown in phantom and the other in solid line, rest on the rear section 23 of the tray 6' bottom wall 22 (FIG. 5) inside the tray. The two inserts 18 as installed in tray 6' are shown also in FIG. 1. The legs 171 and 173 removably support the inserts 18 in the orientation shown in FIG. 1. The inserts 18 are inserted into a desired tray as shown in FIG. 1 to form an inclined bottom wall of the tray bin in place of the horizontal bottom wall 22 thereof. The insert 18 abuts at the junction of the rear section 23 of the bottom wall and the front inclined section 25. The surface 170 of the insert 18 is preferably normal to the side walls 24 and 26 and the plane of the front section 25 of a tray.

To assemble the trays to a stack, the trays 6" tabs 42, 42' of of the trays of the lowermost level 12 are juxtaposed outside of the opposite sides 132 and 136, FIG. 1 (only side 132 being shown in this Fig.) at the upper edges of the support 4. The tabs 152 and 154 of the support 4 are inserted into the lowermost portion of the slots 36, 36' in the lowermost level 12 trays 6" through the slots 40, 40' in the bottom wall 22 of each tray 6". For each subsequent level, the tabs 42, 42' of the next higher level of trays are inserted into the corresponding slots 36, 36' of the next lower tray 6.

When the final upper level 10 is reached, the cap 8 tabs 104 and 106 are inserted into the slots 36, 36' of the next lower trays 6. Also, the straps 50 of the upper level 10 of trays 6, 6' are inserted into the slot 96 in the bottom panel 94 of the cap 8. This holds the top level 10 of trays 6, 6' in abutting back-to-back relation. Also, adhesive, connectors (not shown) or fasteners (not shown) may be used to secure the abutting rear walls 28 of the trays on each level to each other in the back-to-back relation to secure the two stacks in close abutting relation.

As each level 10, 11 and 12 is assembled, the strap members 50 at the rear of each tray is passed through the corresponding slot 60 in the rear wall of the next above tray in the next higher level. The tab 54 is then locked to the slot 56 in the next above tray bottom wall 22. The inserts 18 are selectively inserted in any of the trays as desired. The resulting structure is pleasing to the eye and flexible with respect to the number of trays that can be stacked.

It will occur that various modifications can be made to the disclosed embodiments without departing from the spirit and scope of the appended claims. For example, while two stacks of trays are illustrated one stack may be assembled to a smaller conforming support. If necessary to provide stability to the single stack, a stiff support upright member (not shown) may be attached to the support and extend upwardly therefrom at the rear of the trays. The trays 6 at the upper level may be fastened to such an upright member, e.g., via straps or ties. Preferably the rear walls 28 of the uppermost trays 6 in a dual stack of FIG. 1 are attached to one another to provide further stability to the stacks.

Any number of trays may be secured to the support 4 in any desired number of levels. Once assembled, the trays on a given level appear as a single structure separated only by the lines of the interface therebetween.

What is claimed is:

1. In a display stand comprising at least one stackable first tray, said first tray comprising:

a bottom wall having opposing side edges and a rear edge;

a pair of spaced side walls extending upwardly from the bottom wall at said opposing side edges, said side walls each comprising a pair of juxtaposed walls forming a slot therebetween, said side walls having an upper edge and a bottom edge, said slot being in communication with at least one of said upper and bottom edges;

a rear wall extending upwardly from the bottom wall rear edge and joined to said side walls to form a U-shaped wall therewith; and a pair of tabs extending from and substantially coextensive with each side wall at one of said side wall upper and bottom edges, each tab for corresponding to and engaging a different one of said slots of a second of said plurality of trays stacked therewith;

said bottom wall comprises a rear section and a forward section, said rear section being normal to said side and rear walls, said forward section being inclined upwardly and forwardly from said rear section and forming an open tray front;

the bottom wall forward section comprises at least four layers of juxtaposed sheet material, said tray comprising one piece corrugated paperboard sheet material.

2. In the stand of claim 1 wherein said bottom wall comprises a rear section and a forward section, said rear section being normal to said side and rear walls, said forward section being inclined upwardly and forwardly from said rear section and forming an open tray front.

3. In the stand of claim 1 wherein said pair of tabs comprise a tab downwardly depending from each said side wall bottom edge and the slot is upwardly facing in communication with each said side wall upper edge.

4. In the stand of claim 1 wherein the rear wall has an upper edge, said first tray further including a strap member extending upwardly from the rear wall upper edge, and a second tab extending from the strap member distal said rear wall upper edge, said rear wall having a first slot therein for receiving the strap member of the second tray, said bottom wall having a second slot for receiving and interlocking the second tab thereto for securing the second tray to the first tray in stacked relation.

5. In the stand of claim 1 wherein said first tray has a plurality of further slots therein and a strap member and a further tab secured to the strap member, one of said further slots for receiving a strap member of said second tray and a second of said further slots for receiving said further tab for securing the first tray on and to the second tray in stacked relation.

6. In the stand of claim 2 further including at least one insert for insertion into the first tray and covering said rear section, said at least one insert for forming an inclined bottom wall over said bottom wall rear section and approximately normal to said forward section and side walls.

7. In the stand of claim 6 including a plurality of said inserts in side by side relation on said first tray rear section.

8. In the stand of claim 1 wherein said side walls each have a horizontal rear upper edge and a downwardly forwardly extending inclined forward edge terminating at said rear upper edge and at said forward inclined section.

9. In the stand of claim 8 further including a cap having opposing sides and one of a tab depending from each side and slot, one of said slots and tabs of the first tray upper edge for engaging one of said tabs and slots of said cap so that the cap overlies said bottom wall in spaced relation thereto.

10. In the stand of claim 8 further including a cap wherein the cap is wedge shaped and has an inclined front wall coextensive with the inclined forward edges of said first tray side walls to form a continuous surface with said inclined forward edges which surface terminates at an apex at the top of said cap.

11. In the stand of claim 1 further including a support having a pair of spaced upwardly extending tabs, said first tray bottom wall having a pair of spaced slots each in communication with a different side wall slot, said bottom wall and side wall slots corresponding to and for receiving said support extending tabs, said bottom wall resting on said support.

12. A display stand comprising:

at least one first tray of a first plurality of trays, said at least one first tray comprising:

a bottom wall having opposing side edges and a rear edge;

a pair of spaced side walls extending upwardly from the bottom wall at said opposing side edges, said side walls each having an upper and a lower edge and comprising a pair of juxtaposed walls forming a slot therebetween each in communication with said upper and lower edges;

a rear wall extending upwardly from the bottom wall rear edge and joined to said side walls to form a U-shaped wall therewith; and a pair of tabs extending substantially coextensive with each side wall at one of said side wall upper and lower edges, each tab for engaging a corresponding one of said side wall slots of a second of said plurality of trays stacked with the first tray, each slot of the first tray for receiving a tab of a third of said plurality of trays stacked with the first tray;

a support having opposing sides and one of a slot or an upwardly extending tab at each said opposing sides corresponding to and engaged with one of the respective side wall slots and tabs of the lowermost tray of the first plurality;

a cap having one of a pair of slots or depending spaced tabs, said cap overlying the uppermost of said first plurality of trays, said cap one of a pair of slots or depending spaced tabs engaged with and corresponding to one of the respective tabs and slots of said uppermost tray; and strap means extending from the rear wall of each tray for engaging and securing thereto the next higher tray in the stack.

13. The stand of claim 12 further including a second plurality of said trays on said support stacked on one another forming different tray levels, said first and second plurality of trays forming pairs of trays at each level, the rear walls of the first and second plurality of trays being juxtaposed at each level in back-to-back mirror image relation.

14. The stand of claim 13 wherein said cap overlies each said first and second plurality of stacked trays with the respective tabs and slots thereof engaged with the uppermost of said trays in each said first and second plurality of stacks.

15. The stand of claim 12 wherein said bottom wall comprises a rear section and a forward section, said rear section being normal to said side and rear walls, said forward section being inclined upwardly and forwardly from said rear section.

16. The stand of claim 12 wherein said at least one first tray has a plurality of further slots therein and a strap member and a further tab secured to the strap member, one of said further slots for receiving a strap member of a next lower tray and a second of said further slots for receiving said further tab for securing the at least one tray on and to the next lower tray in stacked relation.

17. The stand of claim 12 wherein the at least one tray, support and cap are each corrugated paperboard, the tray and cap each being one piece.

18. A display stand comprising:

a stack of trays having a lowermost tray and an uppermost tray, each said tray comprising:

a bottom wall having opposing side edges and a rear edge, said bottom wall having a pair of opposing first slots;

a pair of spaced side walls extending upwardly from the bottom wall at said opposing side edges, said side walls each comprising a pair of juxtaposed walls forming a second slot therebetween;

a rear wall extending upwardly from the bottom wall rear edge and joined to said side walls to form a U-shaped wall therewith; and a pair of tabs depending from each side wall at said bottom wall side edges, each tab for engaging a corresponding one of said second slots of a second tray in the stack beneath said at least one first tray bottom wall;

a support having opposing sides and an upwardly extending tab at each said opposing sides received in the lowermost tray of said at least one first tray bottom wall first slots and in said second slots; and a cap having a pair of depending spaced tabs, said cap overlying the uppermost tray of said at least one first tray, said cap depending tabs being engaged with the second slots of the uppermost tray;

said side walls each having an inclined forward edge, said cap having an inclined forward surface and a rear surface terminating at an apex, said cap forward surface being substantially parallel to and coextensive with said side wall forward edges.

19. The stand of claim 18 further including a third tray on said support, said at least one first tray and said third tray forming a pair of trays at a first level, the rear walls of the at least one first and third trays being juxtaposed in back-to-back relation so that the at lest one first and third trays are mirror images of each other, said cap overlying said at least one first and third trays.

20. The stand of claim 18 further including a plurality of said at least one first tray stacked one over the other.

21. The stand of claim 20 including first and second plurality of trays stacked in back-to-back mirror image relation, said cap for overlying said first and second plurality of trays, the tabs of said cap for engaging the second slots of the uppermost trays of the first and second plurality of trays.

22. A display stand comprising:

a tray support;

first and second identical trays each having opposing side walls and a rear wall extending upwardly from a bottom wall forming an open front of the tray, each tray being supported by said support in back-to-back mirror relation with the rear walls next adjacent; and a cap overlying said first and second trays.

23. The stand of claim 22 wherein said side walls each have an inclined forward edge, said cap having inclined forward and rear surfaces terminating at an apex, said cap surfaces being substantially parallel to and coextensive with said side wall forward edges.

24. The stand of claim 22 wherein said trays including identical stacking means for stacking the trays one over the other and including a plurality of said trays identical to and stacked on said first and second trays forming two back-to-back tray stacks facing in opposing directions.

25. The stand of claim 22 wherein each said first and second tray side walls each have bottom and upper edges and comprise a pair of juxtaposed walls forming a vertical slot in communication with the side wall bottom and upper edges, said first and second trays each further including a tab extending from one of said tray bottom and upper edges at each said side wall for engaging a side wall slot of a pair of further trays respectively stacked with said first and second trays.

26. The stand of claim 24 including strap means secured to each said tray for securing an upper tray to the next adjacent lower tray.

27. The stand of claim 24 including securing means for securing the back-to-back stacks to each other.

28. In a display stand comprising at least one stackable first tray, said first tray comprising:

a bottom wall having opposing side edges and a rear edge;

a pair of spaced side walls extending upwardly from the bottom wall at said opposing side edges, said side walls each comprising a pair of juxtaposed walls forming a slot therebetween, said side walls having an upper edge and a bottom edge, said slot being in communication with at least one of said upper and bottom edges;

a rear wall extending upwardly from the bottom wall rear edge and joined to said side walls to form a U-shaped wall therewith; and a pair of tabs extending from and substantially coextensive with each side wall at one of said side wall upper and bottom edges each tab for corresponding to and engaging a different one of said slots of a second of said plurality of trays stacked therewith;

the rear wall having an upper edge, said first tray further including a strap member extending upwardly from the rear wall upper edge, and a second tab extending from the strap member distal said rear wall upper edge, said rear wall having a first slot therein for receiving the strap member of the second tray, said bottom wall having a second slot for receiving and interlocking the second tab thereto for securing the second tray to the first tray in stacked relation.

29. In a display stand comprising at least one stackable first tray, said first tray comprising:

a bottom wall having opposing side edges and a rear edge;

a pair of spaced side walls extending upwardly from the bottom wall at said opposing side edges, said side walls each comprising a pair of juxtaposed walls forming a slot therebetween, said side walls having an upper edge and a bottom edge, said slot being in communication with at least one of said upper and bottom edges;

a rear wall extending upwardly from the bottom wall rear edge and joined to said side walls to form a U-shaped wall therewith; and a pair of tabs extending from and substantially coextensive with each side wall at one of said side wall upper and bottom edges each tab for corresponding to and engaging a different one of said slots of a second of said plurality of trays stacked therewith;

said first tray having a plurality of further slots therein and a strap member and a further tab secured to the strap member, one of said further slots for receiving a strap member of said second tray and a second of said further slots for receiving said further tab for securing the first tray on and to the second tray in stacked relation.

30. A display stand comprising:

at least one first tray of a first plurality of trays, said at least one first tray comprising:

a bottom wall having opposing side edges and a rear edge;

a pair of spaced side walls extending upwardly from the bottom wall at said opposing side edges, said side walls each having an upper and a lower edge and comprising a pair of juxtaposed walls forming a slot therebetween each in communication with said upper and lower edges;

a rear wall extending upwardly from the bottom wall rear edge and joined to said side walls to form a U-shaped wall therewith; and a pair of tabs extending substantially coextensive with each side wall at one of said side wall upper and lower edges, each tab for engaging a corresponding one of said side wall slots of a second of said plurality of trays stacked with the first tray, each slot of the first tray for receiving a tab of a third of said plurality of trays stacked with the first tray;

a support having opposing sides and one of a slot or an upwardly extending tab at each said opposing sides corresponding to and engaged with one of the respective side wall slots and tabs of the lowermost tray of the first plurality; and a cap having one of a pair of slots or depending spaced tabs, said cap overlying the uppermost of said first plurality of trays, said cap one of a pair of slots or depending spaced tabs engaged with and corresponding to one of the respective tabs and slots of said uppermost tray;

said at least one first tray has a plurality of further slots therein and a strap member and a further tab secured to the strap member, one of said further slots for receiving a strap member of a next lower tray and a second of said further slots for receiving said further tab for securing the at least one tray on and to the next lower tray in stacked relation.

31. A display stand comprising:

at least one first tray of a first plurality of trays, said at least one first tray comprising:

a bottom wall having opposing side edges and a rear edge;

a pair of spaced side walls extending upwardly from the bottom wall at said opposing side edges, said side walls each having an upper and a lower edge and comprising a pair of juxtaposed walls forming a slot therebetween each in communication with said upper and lower edges;

a rear wall extending upwardly from the bottom wall rear edge and joined to said side walls to form a U-shaped wall therewith; and a pair of tabs extending substantially coextensive with each side wall at one of said side wall upper and lower edges, each tab for engaging a corresponding one of said side wall slots of a second of said plurality of trays stacked with the first tray, each slot of the first tray for receiving a tab of a third of said plurality of trays stacked with the first tray;

a support having opposing sides and one of a slot or an upwardly extending tab at each said opposing sides corresponding to and engaged with one of the respective side wall slots and tabs of the lowermost tray of the first plurality; and a cap having one of a pair of slots or depending spaced tabs, said cap overlying the uppermost of said first plurality of trays, said cap one of a pair of slots or depending spaced tabs engaged with and corresponding to one of the respective tabs and slots of said uppermost tray;

a second plurality of said trays on said support stacked on one another forming different tray levels, said first and second plurality of trays forming pairs of trays at each level, the rear walls of the first and second plurality of trays being juxtaposed at each level in back-to-back mirror image relation;

said cap overlying each said first and second plurality of stacked trays with the respective tabs and slots thereof engaged with the uppermost of said trays in each said first and second plurality of stacks.

32. In a display stand comprising at least one stackable first tray, said first tray comprising:

a bottom wall having opposing side edges and a rear edge;

a pair of spaced side walls extending upwardly from the bottom wall at said opposing side edges, said side walls each comprising a pair of juxtaposed walls forming a slot therebetween, said side walls having an upper edge and a bottom edge, said slot being in communication with at least one of said upper and bottom edges;

a rear wall extending upwardly from the bottom wall rear edge and joined to said side walls to form a U-shaped wall therewith; and a pair of tabs extending from and substantially coextensive with each side wall at one of said side wall upper and bottom edges each tab for corresponding to and engaging a different one of said slots of a second of said plurality of trays stacked therewith;

said bottom wall comprising a rear section and a forward section, said rear section being normal to said side and rear walls, said forward section being inclined upwardly and forwardly from said rear section and forming an open tray front; and at least one insert for insertion into the first tray and covering said rear section, said at least one insert for forming an inclined bottom wall over said bottom wall rear section and approximately normal to said forward section and side walls.

33. In a display stand comprising at least one stackable first tray, said first tray comprising:

a bottom wall having opposing side edges and a rear edge;

a pair of spaced side walls extending upwardly from the bottom wall at said opposing side edges, said side walls each comprising a pair of juxtaposed walls forming a slot therebetween, said side walls having an upper edge and a bottom edge, said slot being in communication with at least one of said upper and bottom edges;

a rear wall extending upwardly from the bottom wall rear edge and joined to said side walls to form a U-shaped wall therewith;

a pair of tabs extending from and substantially coextensive with each side wall at one of said side wall upper and bottom edges each tab for corresponding to and engaging a different one of said slots of a second of said plurality of trays stacked therewith;

said side walls each having a horizontal rear upper edge and a downwardly forwardly extending inclined forward edge terminating at said rear upper edge and at said forward inclined section; and a wedged shaped cap with an inclined front wall coextensive with the inclined forward edges of said first tray side walls to form a continuous surface with said inclined forward edges which surface terminates at an apex at the top of said cap.

* * * * *